US008763577B2

(12) United States Patent
Beckmann et al.

(10) Patent No.: US 8,763,577 B2
(45) Date of Patent: Jul. 1, 2014

(54) METHOD AND CONTROL DEVICE FOR STARTING AN INTERNAL COMBUSTION ENGINE COMPRISING A HEATING DEVICE FOR HEATING A COOLANT

(75) Inventors: Reiner Beckmann, Schifferstadt (DE); Jörg Herrlitz, Ingolstadt (DE)

(73) Assignee: Continental Automotive GmbH, Hannover (DE)

( * ) Notice: Subject to any disclaimer, the term of this patent is extended or adjusted under 35 U.S.C. 154(b) by 906 days.

(21) Appl. No.: 12/933,562

(22) PCT Filed: Feb. 27, 2009

(86) PCT No.: PCT/EP2009/052408

§ 371 (c)(1),
(2), (4) Date: Nov. 3, 2010

(87) PCT Pub. No.: WO2009/115406

PCT Pub. Date: Sep. 24, 2009

(65) Prior Publication Data

US 2011/0067665 A1 Mar. 24, 2011

(30) Foreign Application Priority Data

Mar. 20, 2008 (DE) ..... 10 2008 015 283

(51) Int. Cl.
*F02N 19/10* (2010.01)

(52) U.S. Cl.
USPC ..... 123/179.21; 701/113

(58) Field of Classification Search
USPC ..... 123/179.21, 142.5 E, 142.5 R; 701/113
See application file for complete search history.

(56) References Cited

U.S. PATENT DOCUMENTS

| | | | | | |
|---|---|---|---|---|---|
| 4,348,992 | A * | 9/1982 | Southard | ..... | 123/142.5 R |
| 5,469,819 | A * | 11/1995 | Berger et al. | ..... | 123/179.6 |
| 5,781,877 | A | 7/1998 | Rachel et al. | ..... | 701/104 |
| 6,092,496 | A * | 7/2000 | Bhargava et al. | ..... | 123/90.15 |
| 6,138,618 | A * | 10/2000 | Genster | ..... | 123/41.14 |
| 6,714,854 | B2 * | 3/2004 | Linenberg et al. | ..... | 701/113 |
| 6,843,216 | B2 * | 1/2005 | Suzuki et al. | ..... | 123/142.5 R |
| 6,931,865 | B1 * | 8/2005 | Van Gilder et al. | ..... | 62/129 |

(Continued)

FOREIGN PATENT DOCUMENTS

| | | | | |
|---|---|---|---|---|
| DE | 19608340 | 9/1997 | ..... | F02D 41/06 |
| EP | 0816652 | 1/1998 | ..... | F01P 11/20 |

(Continued)

OTHER PUBLICATIONS

International Search Report and Written Opinion for Application No. PCT/EP2009/052408 (17 pages), Apr. 20, 2009.

(Continued)

*Primary Examiner* — Hieu T Vo
*Assistant Examiner* — Arnold Castro
(74) *Attorney, Agent, or Firm* — King & Spalding L.L.P.

(57) ABSTRACT

In a method, the starting behavior of an internal combustion engine (1) with a heating device (40) for heating a coolant is improved. According to the method, the temperature of the coolant to be heated by the heating device (40) and an additional temperature that is associated with the internal combustion engine (1), are determined. The temperatures are compared and a starting fuel amount is determined in accordance with the compared temperatures. The internal combustion engine (1) is started by metering the starting fuel amount.

16 Claims, 3 Drawing Sheets

(56) References Cited

U.S. PATENT DOCUMENTS

| | | | | |
|---|---|---|---|---|
| 7,277,791 | B2 * | 10/2007 | Petrosius et al. | 701/112 |
| 7,464,699 | B2 * | 12/2008 | Joppig et al. | 123/556 |
| 7,757,649 | B2 * | 7/2010 | Wakahara | 123/142.5 E |
| 7,769,505 | B2 * | 8/2010 | Rask et al. | 701/22 |
| 7,963,832 | B2 * | 6/2011 | Bellinger | 454/155 |
| 7,975,536 | B2 * | 7/2011 | Bommer et al. | 73/114.68 |
| 8,047,165 | B2 * | 11/2011 | Ito et al. | 123/41.01 |
| 8,140,246 | B1 * | 3/2012 | Manchanda | 701/107 |
| 2002/0005178 | A1 * | 1/2002 | Iwatani et al. | 123/41.14 |
| 2002/0011236 | A1 * | 1/2002 | Suzuki et al. | 123/406.53 |
| 2003/0177985 | A1 * | 9/2003 | Engelin et al. | 123/41.1 |
| 2004/0044462 | A1 * | 3/2004 | Linenberg et al. | 701/113 |
| 2004/0045528 | A1 * | 3/2004 | Suzuki et al. | 123/406.53 |
| 2004/0173165 | A1 * | 9/2004 | Sieber et al. | 123/3 |
| 2007/0084427 | A1 * | 4/2007 | Petrosius et al. | 123/142.5 E |
| 2008/0245319 | A1 * | 10/2008 | Toyoshima et al. | 123/41.14 |
| 2008/0300774 | A1 * | 12/2008 | Wakahara | 701/113 |
| 2009/0071428 | A1 * | 3/2009 | Kamiyama et al. | 123/142.5 R |
| 2009/0182489 | A1 * | 7/2009 | Yang et al. | 701/113 |
| 2009/0319162 | A1 * | 12/2009 | Bommer et al. | 701/113 |

FOREIGN PATENT DOCUMENTS

| | | | |
|---|---|---|---|
| EP | 1079089 | 2/2001 | F02D 41/06 |
| EP | 1176299 | 1/2002 | F02D 41/06 |
| JP | 2002266679 A | 9/2002 | F02D 41/06 |
| WO | 2009115406 | 9/2009 | F02N 17/06 |

OTHER PUBLICATIONS

German Office Action, German patent application No. 10 2008 015 283.8-15, 4 pages, Oct. 29, 2008.

* cited by examiner

METHOD AND CONTROL DEVICE FOR STARTING AN INTERNAL COMBUSTION ENGINE COMPRISING A HEATING DEVICE FOR HEATING A COOLANT

CROSS-REFERENCE TO RELATED APPLICATIONS

This application is a U.S. National Stage Application of International Application No. PCT/EP2009/052408 filed Feb. 27, 2009, which designates the United States of America, and claims priority to German Application No. 10 2008 015 283.8 filed Mar. 20, 2008, the contents of which are hereby incorporated by reference in their entirety.

TECHNICAL FIELD

The invention relates to a method and to a control device for starting an internal combustion engine comprising a heating device for heating a coolant.

BACKGROUND

To improve the starting behavior and the comfort when outside temperatures are cold, many internal combustion engines—at least optionally—have a heating device, by means of which the coolant of the internal combustion engine can be preheated. Such heating devices are also offered for retrofitting and can be operated by connecting them to an external power source. Modern internal combustion engines also mostly have a control device by means of which all sequences and control elements of the internal combustion engine can be controlled to take account of the wishes of the driver, driving comfort, safety functions and emission behavior etc. To this end the control device exerts influence on manipulated variables influencing the torque of the internal combustion engine, such as the amount of fuel to be injected for example, the ignition angle, the amount of fresh air supplied or the exhaust gas feedback rate. This is intended to optimize the engine combustion and the torque delivered.

The starting of the internal combustion engine is also controlled by the control device. To guarantee secure cold starting of the internal combustion engine even when outside temperatures are low, it is known that the amount of fuel needed for starting can be determined as a function of the coolant temperature of the internal combustion engine.

With an internal combustion engine which is equipped with a heating device as described above for heating the coolant, the starting behavior of the internal combustion engine can be noticeably adversely affected however. As well as the greater inconvenience of the long start time, increased pollutant emissions can also result.

SUMMARY

According to various embodiments, a method and a control device can be provided by means of which the process security on starting the internal combustion engine with a heating device for heating a coolant can be improved.

According to an embodiment, in a method of starting an internal combustion engine with a heating device for heating a coolant, a temperature of the coolant able to be heated by the heating device being detected, an additional temperature which is assigned to the internal combustion engine being determined, the temperatures being compared, a starting fuel amount being determined as a function of the comparison of the temperatures, the internal combustion engine being started by metering the starting fuel amount.

According to a further embodiment, the time since the internal combustion engine was last switched off can be determined, the temperatures being compared after a predetermined time span has elapsed since the internal combustion engine was last switched off, and the starting fuel amount being determined as a function of the comparison of the temperatures after the predetermined time span has elapsed. According to a further embodiment, the time span can be determined as a function of the temperature of the heatable coolant when the internal combustion engine was last switched off. According to a further embodiment, the starting fuel amount can be increased if the temperatures differ by more than a predetermined threshold value.

According to another embodiment, in an application of the method as described above to an internal combustion engine with a control device, the control device has no information available to it about the operating state of the heating device.

According to a further embodiment of the application, the heating device may have an external energy supply. According to a further embodiment of the application, the internal combustion engine may be able to be operated with a number of different fuels which differ in their combustion properties.

According to yet another embodiment, a control device for an internal combustion engine with a heating device for heating a coolant may be embodied such that for starting the internal combustion engine, a temperature of the coolant able to be heated by the heating device is detected, an additional temperature is determined which is assigned to the internal combustion engine, the temperatures are compared, a starting fuel amount is determined at a function of the comparison of the temperatures, and the internal combustion engine is started by metering the starting fuel amount.

BRIEF DESCRIPTION OF THE DRAWINGS

An exemplary embodiment of the present example is explained in greater detail below with reference to the enclosed figures. The figures show.

DETAILED DESCRIPTION

Figure 1A:
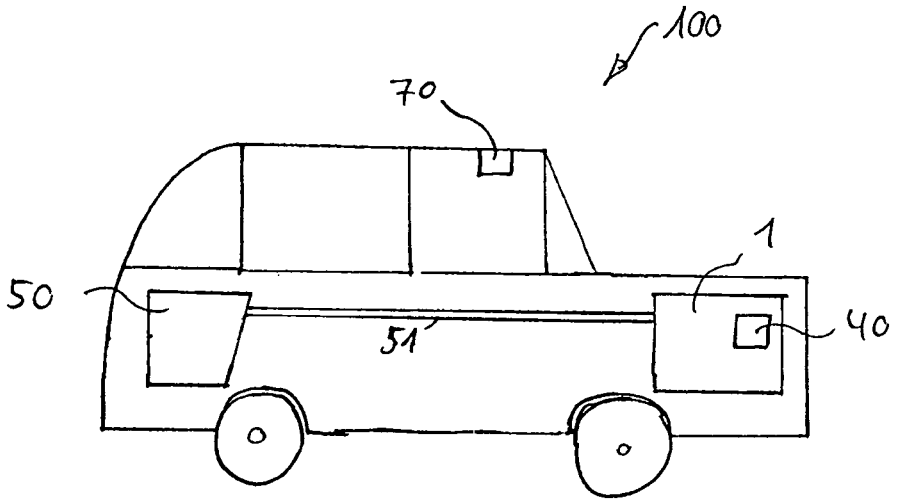
FIG. 1A a schematic diagram of a motor vehicle with an internal combustion engine.

In a method for starting an internal combustion engine with a heating device for heating a coolant in accordance with an embodiment, a temperature of the coolant able to be heated by the heating device is detected. An additional temperature is determined which is assigned to the internal combustion engine. The temperatures are compared and a starting fuel amount is determined as a function of the comparison of the temperatures. Subsequently the internal combustion engine is started by dispensing the starting fuel amount.

With conventional control methods for starting an internal combustion engine the amount of fuel necessary for starting the engine is determined as a function of the temperature of the coolant. To guarantee a secure starting process the amount of fuel necessary for starting must be increased as the temperature falls. If the internal combustion engine now has a heating device for heating the coolant it occurs that with an active heating device the coolant already has a far higher temperature than the engine block or the combustion chambers of the internal combustion engine. As a result of this errors can occur in specifying the amount of fuel for starting, which means that a secure start can no longer be guaranteed. This problem occurs in particular if the start device of the internal combustion engine does not have any information available to it about the activity or the operating status of the heating device, which is for example the case with retrofittable heating devices. The various embodiments are based on the idea, in addition to determining the temperature of the coolant able to be heated by the heating device, of determining an additional temperature which is assigned to the internal combustion engine. For example this additional temperature can represent a measure of the ambient temperature of the internal combustion engine. The additional temperature is selected so that the heating device has no influence on it or only an indirect influence. This means that the additional temperature differs with an active heating device at least from time to time from the temperature of the heatable coolant. The additional temperature can for example be determined on the basis of the output signal of a sensor of the internal combustion engine or of a motor vehicle which is driven by the internal combustion engine and represents an operating parameter for controlling the internal combustion engine. The two temperatures are compared in accordance with the method and the starting fuel amount is determined as a function of the comparison or the difference between the temperatures. The comparison of the two temperatures allows conclusions to be drawn about the activity of the heating device and a corresponding adaptation of the starting fuel amount.

In one embodiment of the method the time since the internal combustion engine was last switched off is determined and the temperature of the heatable coolant is compared with the additional temperature only once a predetermined time span since the internal combustion engine was last switched off has elapsed. The starting fuel amount is determined as a function of the comparison between the temperatures after the predetermined time span has elapsed.

Since the problems described above on starting the internal combustion engine only occur when a sufficiently large temperature difference exists between the engine block and the heatable coolant, the method in accordance with this embodiment is only carried out once a predetermined time span since the internal combustion engine was last switched off has elapsed. The reason for this is that the internal combustion engine needs a certain time to cool down far enough. If the internal combustion engine at operating temperature is started again a short time after being switched off, the activation of the heating device is rather unlikely and the above-mentioned problems on restarting the internal combustion engine at least do not appear to such a great extent.

In an embodiment of the method the time span is determined as a function of the temperature of the heatable coolant when the internal combustion engine was last switched off.

The lower the temperature of the coolant when the internal combustion engine is switched off the faster the internal combustion engine or the engine block cool down to critical temperatures at which problems when restarting the internal combustion engine occur. In this regard the time span is shorter, the lower the temperature of the coolant is when the internal combustion engine was last switched off.

In an embodiment of the method, the starting fuel amount is increased if the temperatures—i.e. the temperature of the heatable coolant and the additional temperature—differ by more than a predetermined threshold value.

If the temperature of the heatable coolant and the additional temperature differ by more than the predetermined threshold value, it is to be assumed that the heatable coolant will be heated by means of the heating device, whereas the internal combustion engine or the engine block and the combustion chambers exhibit a significantly lower temperature. In this case, to guarantee a secure start process, the starting fuel amount must be increased, i.e. the start process is carried out with a richer mixture.

According to a further embodiment, the method as described above can be used in an internal combustion engine with a control device which has no information available to it about the operating state of the heating device.

Especially when the control device has no information about whether the heating device is active and the coolant is being heated, problems can occur during the start process because of the different temperatures of the heatable coolant and the engine block or the combustion chambers.

To this extent the use of the method in an internal combustion engine of which the heating device has an external energy supply is especially advantageous.

In an embodiment the method is applied to an internal combustion engine which is able to be driven by a number of different fuels, with the fuels differing in their combustion properties.

This application is especially aimed at so-called bi-fuel vehicles, which in addition to conventional Otto or diesel fuel are also able to be driven with an alternate fuel, such as alcohol or rape seed oil. The problem can occur here, for an active heating device and only considering the coolant temperature, of it being concluded that the temperature of the internal combustion engine is too high on starting and too small an amount of alternate fuel is metered for starting the internal combustion engine, which negatively affects the start behavior of the internal combustion engine. This problem is to be seen as especially critical since, when switching fuel (refilling with alternate fuel) the control device does not have any information about the type of fuel on starting.

According to a further embodiment, a control device for an internal combustion engine with a heating device for heating a coolant may be embodied such that it carries out the method for starting the internal combustion engine as described above. To this end the corresponding control functions are implemented by software in the control device. As regards the advantages produced thereby, the reader is referred to the remarks relating to the various embodiments of the method as described above.

FIG. 1A shows a schematic diagram of a motor vehicle 100. The motor vehicle comprises an interior temperature sensor 70, an internal combustion engine 1, a fuel tank 50 which is able to be filled with conventional Otto fuel or with an alternate fuel based on alcohol. Both fuels differ in their combustion properties (for example the ignition temperature, calorific value, viscosity etc.). The fuel tank 50 is connected via a supply line 51 to the internal combustion engine 1. The internal combustion engine 1 is embodied such that it can be operated with the two fuels. The internal combustion engine further features a heating device 40, by means of which a coolant of the internal combustion engine 1 is able to be heated.

Figure 1B:
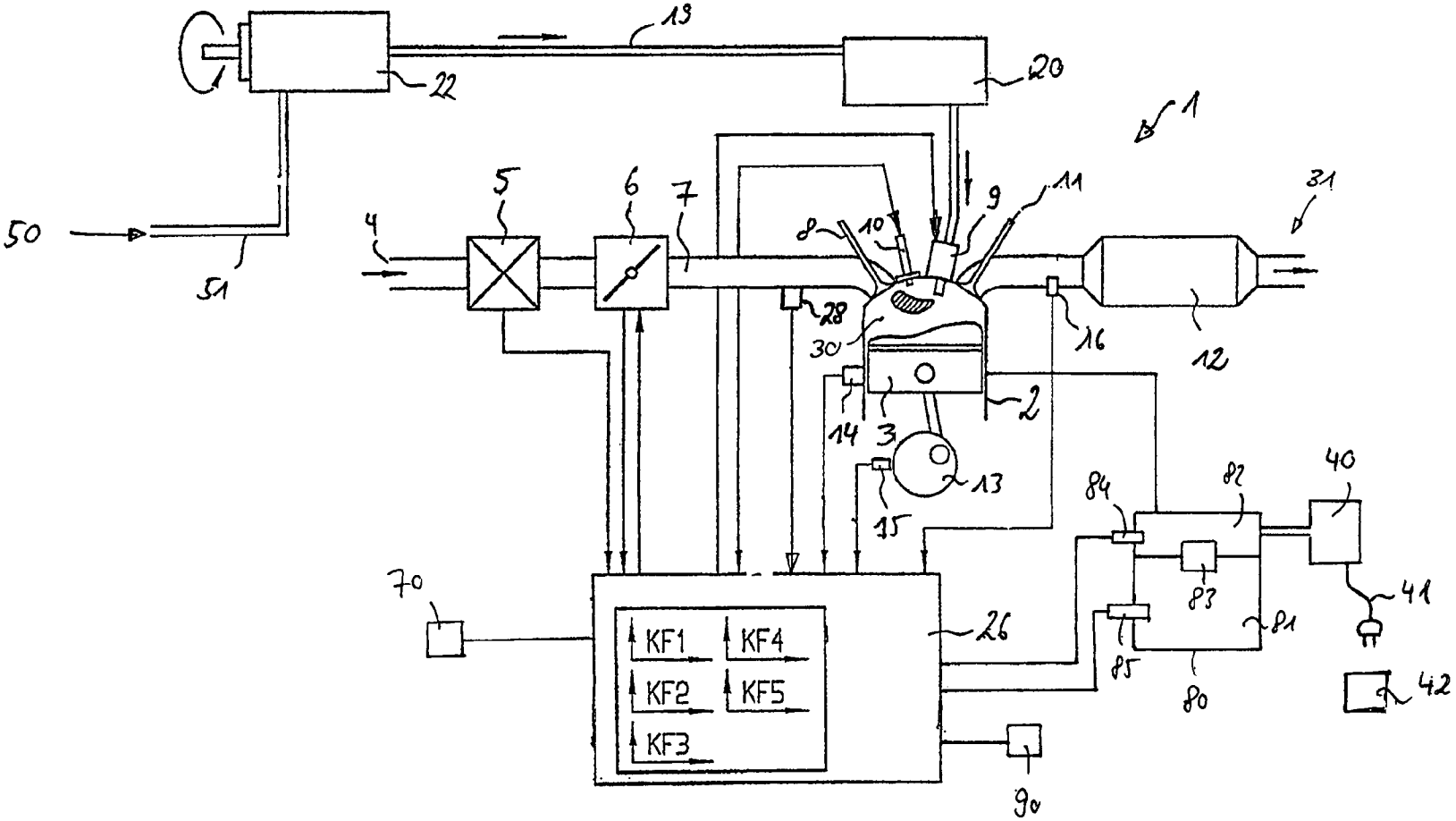
FIG. 1B a schematic diagram of the internal combustion engine.

FIG. 1B shows further details of the internal combustion engine 1 schematically. For reasons of improved clarity the diagram is greatly simplified.

The internal combustion engine 1 comprises at least one cylinder 2 and a piston 3 able to be moved up and down in the cylinder 2. The internal combustion engine further comprises an intake 4 in which an air mass sensor 5, a throttle valve 6, an inlet manifold 7 as well as an inlet air temperature sensor 28 are arranged downstream of an inlet opening. The intake opens out into a combustion chamber 30 delimited by the cylinder 2 and the piston 3. The fresh air required for combustion is introduced by the intake into the combustion chamber, with the supply of fresh air being controlled by opening and closing an inlet valve 8. The internal combustion engine 1 shown here involves an internal combustion engine 1 with direct fuel injection, in which the fuel necessary for combustion is injected directly into the combustion chamber 30 via an injection valve 9. A spark plug 10 likewise protruding into the combustion chamber 30 serves to initiate the combustion. The combustion exhaust gases are taken away via an outlet valve 11 into an exhaust duct 31 of the internal combustion engine 1 and cleaned by means of an exhaust gas catalytic converter 12 arranged in the exhaust duct 31. A Lambda sensor 16 is arranged in the exhaust duct.

Force is transmitted to the drive train of the motor vehicle 100 via a crankshaft 13 coupled to the piston 3. The internal combustion engine 1 also has an engine speed sensor 15 for detecting the rotational speed of the crankshaft 13 as well as an engine block temperature sensor 14, which can be an oil temperature sensor.

The internal combustion engine 1 has a fuel supply system to which the fuel tank 50 and the first supply line 51 belong. The fuel contained in the fuel tank 50 is fed via the supply line 51 and a further supply line to a fuel reservoir 20. This involves a common reservoir 20 from which the injection valves for a number of cylinders 2 are supplied with pressurized fuel. Between the supply line 51 and the further supply line 19 is arranged a high-pressure pump 22. The high-pressure pump 22 serves to supply the reservoir 20 with fuel at high-pressure (typically up to 150 bar).

The internal combustion engine has a coolant circuit 80 which is divided up into a small coolant circuit 82 and a large coolant circuit 81. The small coolant circuit 82 and the large coolant circuit 81 are connected by means of a thermostat as from a specific switching temperature so that the coolants of the two coolant circuits 81, 82 mix. Below the specific switching temperature the thermostat is closed and the two coolant circuits 81, 82 are separated. The temperature of the coolant in the small coolant circuit 82 is measured by means of a first temperature sensor 84. The temperature of the coolant in the large coolant circuit 81 is measured by means of a second temperature sensor 85.

The internal combustion engine further includes a heating device 40 which is coupled to the coolant circuit 80 such that the coolant contained in a small coolant circuit 82 is able to be heated. The heating device 40 can for example be embodied as an electrically driven heat exchanger which is coupled to the small coolant circuit 82 for heat transfer. The heating device 40 can be connected via a power supply line 41 to an external power source 42 and can be supplied with energy from there. Energy can alternately also be supplied by an internal voltage source, e.g. battery of the motor vehicle (not shown)). As an alternative the heating device can involve a heat exchanger with a separate burner, as is known from conventional continuous flow heaters.

The internal combustion engine is also assigned an ambient temperature sensor 90.

The internal combustion engine 1 is assigned a control device 26 which is connected via signal and data lines to all actuators and sensors of the internal combustion engine 1 and of the motor vehicle 100. Implemented by software in the control device 26 are engine-map-based engine control functions KF1 to KF5. Based on the measured values of the sensors and the engine-map-based engine control functions, control signals are transmitted to the actuators of the internal combustion engine 1 and the fuel supply system. In concrete terms the control device 26 is connected via data and signal lines to the internal temperature sensor 70, the air mass sensor 5, the throttle valve 6, the spark plug 10, the injection valve 9, the inlet air temperature sensor 28 the engine block temperature sensor 14, the RPM sensor 18, the Lambda sensor 16, the ambient temperature sensor 90, the first temperature sensor 84 and the second temperature sensor 85. The control device does not however have any information about the operating state of the heating device 40.

The vehicle driver now has the opportunity, when the internal combustion engine 1 is switched off, of activating the heating device 40 and heating up the coolant. This is especially advantageous at low ambient temperatures, since immediately after the start of the internal combustion engine 1, the heat of the coolant of the small coolant circuit 82 can be used for heating up the interior. The engine block will also be preheated which facilitates the starting process.

The start capability of the internal combustion engine significantly deteriorates as the temperature falls. The reasons for this are above all to be seen in the greatly reduced fuel vaporization, the degraded fuel mixture preparation, the wall film formation and the greater viscosity of the fuels.

In accordance with a known control method the amount of fuel needed for starting the internal combustion engine 1 is therefore determined as a function of the coolant temperature of the small coolant circuit 82. For this purpose a basic amount of fuel is corrected by a correction value. The lower the temperature is, the more fuel must be supplied for starting the internal combustion engine 1. For an internal combustion engine 1 described above which has a heating device 40 for heating the coolant, this method of operation can be inadequate, whereby problems can emerge in relation to the reliability of the start process and the pollutant emissions. In specific situations the temperature of the coolant able to be heated by the heating device can be far higher than the temperature of the engine block or of the combustion chambers 30 respectively. This occurs especially with very low outside temperatures, when the internal combustion engine 1 has been turned off for a long period and with short activity of the heating device 40. If the temperature of the heatable coolant is thus included in this situation, this is not representative of the temperature of the engine block and the amount of fuel needed to start the engine is consequently incorrectly calculated.

Figure 2:
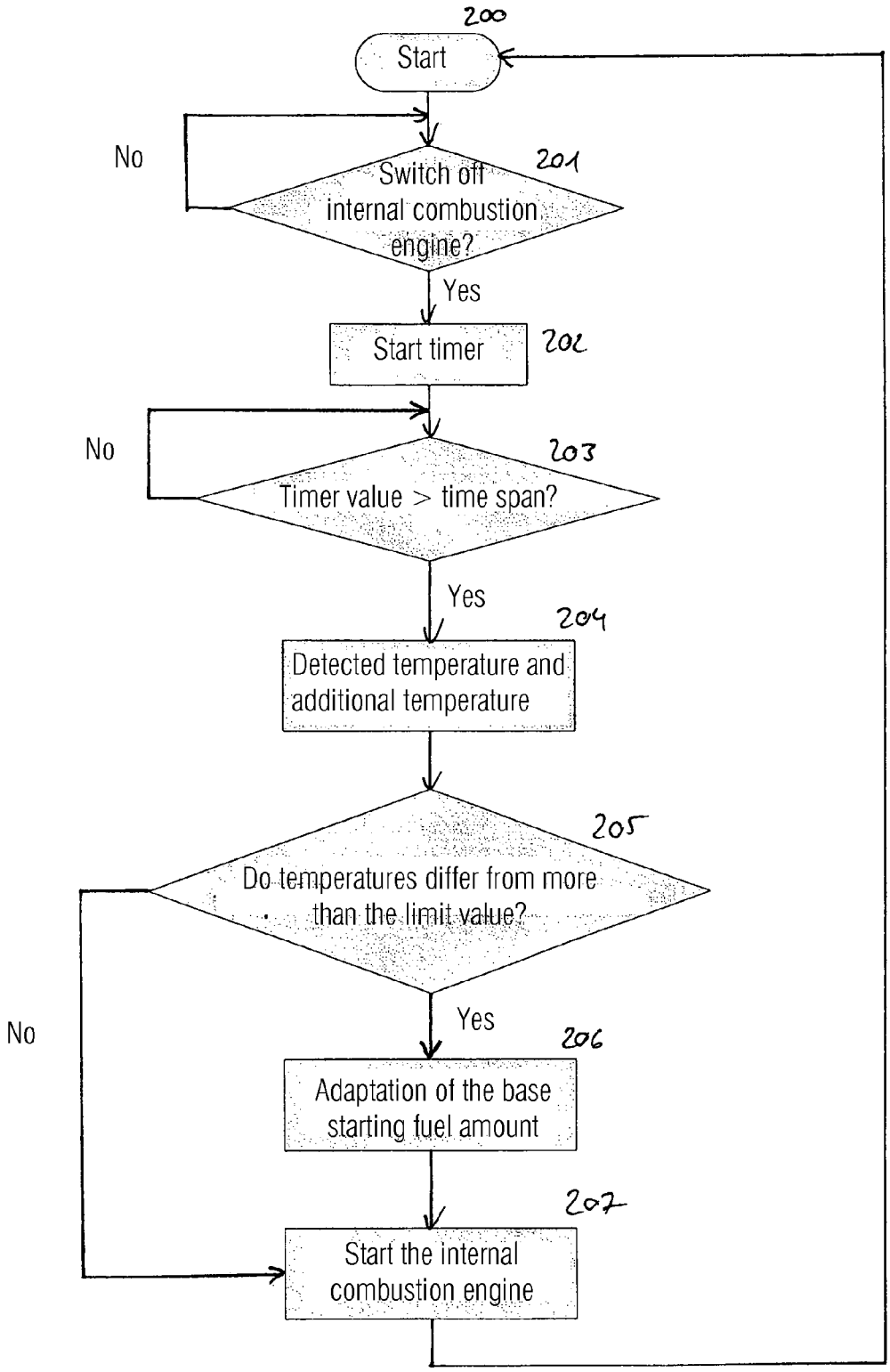
FIG. 2 an exemplary embodiment in the form of a flow diagram of a method for starting the internal combustion engine.

FIG. 2 shows an exemplary embodiment of a method for starting the internal combustion engine, in the form of a flow diagram, through which the above-mentioned problem is solved.

The method is started in step 200, for example when the internal combustion engine 1 is put into service for the first time or when the ambient temperature falls below a predetermined threshold value.

The method continues with step 201, in which a check is made as to whether the internal combustion engine 1 has been switched off. This interrogation is repeated in the event of a negative result. If the result of the interrogation is positive the method continues with step 202, in which a timer implemented in the control device 26 is started which measures the time as from the internal combustion engine 1 being switched off.

In step 203 a check is made as to whether the value of the timer is greater than a predetermined time span. This interrogation is repeated until a positive result is produced. The time span can have a fixed value in this case or will be as specified as a function of the temperature of the coolant of the large or the small coolant circuit at the time that the internal combustion engine 1 is switched off. The value of the time span in this case is shorter, the lower the temperature of the coolant was at the time that the internal combustion engine 1 was switched off. The fact that the method only continues after the time span since the internal combustion engine 1 was switched off has elapsed takes account of the situation in which the internal combustion engine 1 or the engine block needs a certain time to cool down from operating temperature to temperature ranges critical for the start. The time span in this case is shorter, the lower the temperature of the internal combustion engine 1 was at the time of the switched off. Advantageously the temperature of the engine block, of the coolant or of the oil can be used as a measure the temperature of the internal combustion engine.

After a positive result of the interrogation in step 203 the method continues with step 204 in which the temperature of the heatable coolant (here: the temperature of the small coolant circuit) and an additional temperature are detected. The additional temperature can for example involve the ambient temperature, the induction air temperature, the oil temperature or the temperature of the engine block. It is however also possible to use the interior temperature of the motor vehicle 100. The additional temperature is thus selected so that the heating device 40 has no influence on it or only an indirect influence. This means that the additional temperature differs at least from time to time from the temperature of the heatable coolant when the heating device is active. The additional temperature thus lies closer to the actual temperature of the engine block and represents this better than the temperature of the heatable coolant.

In step 205 a check is made as to whether the temperature of the heatable coolant and the additional temperature differ by more than a threshold value.

With a positive result of the interrogation in step 205 the method continues with step 206 in which the starting fuel amount is determined as a function of the comparison of the temperature of the coolant and the additional temperature. In concrete terms this can occur such that a base starting fuel amount is corrected by a correction value. The correction value is determined in such cases as a function of the difference between the temperature of the heatable coolant and the additional temperature. The greater the difference between the two temperatures is, the larger is the correction value which is applied to the base starting fuel amount. Consequently, for starting the internal combustion engine 1 more fuel is injected into the combustion chambers, which produces a rich fuel mixture and a secure start process of the internal combustion engine 1 can be guaranteed in this way.

After step 206 the internal combustion engine is started in step 207 by metering the adapted starting fuel amount if a request for starting the internal combustion engine is detected. With a negative result of the interrogation in step 205 the internal combustion engine is started by metering the uncorrected base starting fuel amount.

The method is then started again with step 200.

In accordance with the method shown here the temperature of the heatable coolant is compared to an additional temperature which is assigned to the internal combustion engine. This comparison enables an active heating device to be deduced and the starting fuel amount required for a secure start will be much more precise. In this way the start behavior and the emission behavior of the internal combustion engine can be greatly improved.

What is claimed is:

1. A method of starting an internal combustion engine with a heating device for heating a coolant, comprising:

determining a time since the internal combustion engine was last switched off, and only if the determined time exceeds a defined threshold time span, performing the following process to determine and meter a starting fuel amount:

measuring a temperature of the coolant heated by the heating device, measuring an additional temperature which is assigned to the internal combustion engine, wherein the additional temperature is not influenced, or only indirectly influenced, by the heating device, comparing the measured temperature of the heated coolant with the measured additional temperature assigned to the internal combustion engine, determining a starting fuel amount as a function of the difference between the measured temperature of the heated coolant and the measured additional temperature assigned to the internal combustion engine, and starting the internal combustion engine by metering the starting fuel amount.

2. The method according to claim 1, comprising setting the defined threshold time span as a function of a measured temperature of the heatable coolant when the internal combustion engine was last switched off.

3. The method according to claim 1, wherein the starting fuel amount is increased if the temperatures differ by more than a predetermined threshold value.

4. The method according to claim 1, further comprising: using said method in combination with an internal combustion engine with a control device, which has no information available to it about the operating state of the heating device.

5. The method according to claim 4, wherein the heating device having an external energy supply.

6. The method according to claim 4, wherein the internal combustion engine is able to be operated with a number of different fuels which differ in their combustion properties.

7. A control device for an internal combustion engine with a heating device for heating a coolant, wherein the control device is configured to:

determine a time since the internal combustion engine was last switched off, and only if the determined time exceeds a defined threshold time span, perform the following process to determine and meter a starting fuel amount:

receive a measured temperature of the coolant heated by the heating device is detected, receive an additional measured temperature assigned to the internal combustion engine, wherein the additional temperature is not influenced, or only indirectly influenced, by the heating device, compare the measured temperature of the heated coolant with the measured additional temperature assigned to the internal combustion engine, determine a starting fuel amount at a function of the difference between the measured temperature of the heated coolant and the measured additional temperature assigned to the internal combustion engine, and start the internal combustion engine by metering the starting fuel amount.

8. The method according to claim 5, wherein the internal combustion engine is able to be operated with a number of different fuels which differ in their combustion properties.

9. A system of starting an internal combustion engine with a heating device for heating a coolant, comprising:

an internal combustion engine, a heating device, and a control device being operable to:

determine a time since the internal combustion engine was last switched off, and only if the determined time exceeds a defined threshold time span, perform the following process to determine and meter a starting fuel amount:

receive a first measured temperature of the coolant heated by the heating device, receive a second measured temperature which is assigned to the internal combustion engine, wherein the second measured temperature assigned to the internal combustion engine is not influenced, or only indirectly influenced, by the heating device, compare the first measured temperature of the heated coolant with the second measured temperature assigned to the internal combustion engine, determine a starting fuel amount as a function of the difference between the first measured temperature of the heated coolant and the second measured temperature assigned to the internal combustion engine, and start the internal combustion engine by metering the starting fuel amount.

10. The system according to claim 9, wherein the control device is further operable to determine the defined threshold time span as a function of a measured temperature of the heatable coolant when the internal combustion engine was last switched off.

11. The system according to claim 9, wherein the control device is further operable to increase the starting fuel amount if the temperatures differ by more than a predetermined threshold value.

12. The system according to claim 9, wherein the control device has no information available about the operating state of the heating device.

13. The system according to claim 9, wherein the heating device has an external energy supply.

14. The system according to claim 12, wherein the internal combustion engine is able to be operated with a number of different fuels which differ in their combustion properties.

15. The system according to claim 13, wherein the internal combustion engine is able to be operated with a number of different fuels which differ in their combustion properties.

16. A method of starting an internal combustion engine with a heating device for heating a coolant, comprising:

after the coolant has been heated by the heating device, measuring both (a) a temperature of the coolant heated by the heating device and (b) an additional temperature which is assigned to the internal combustion engine, wherein the additional temperature represents an ambient temperature of the internal combustion engine and is not influenced, or only indirectly influenced, by the heating device, comparing the measured temperature of the heated coolant with the measured additional temperature assigned to the internal combustion engine, determining a starting fuel amount as a function of the difference between the measured temperature of the heated coolant and the measured additional temperature assigned to the internal combustion engine, and starting the internal combustion engine by metering the starting fuel amount.

* * * * *